United States Patent [19]

Oide

[11] Patent Number: 4,556,161

[45] Date of Patent: Dec. 3, 1985

[54] STAPLER AND STAPLES TO BE MOUNTED

[75] Inventor: Kunimasa Oide, Osaka, Japan

[73] Assignee: Daichiku Co., Ltd., Osaka, Japan

[21] Appl. No.: 467,029

[22] Filed: Feb. 16, 1983

[51] Int. Cl.[4] ..... B25C 5/02; B25C 5/04; B25C 5/06; B25C 5/08

[52] U.S. Cl. ..... 227/83; 227/120; 227/109; 227/156

[58] Field of Search ..... 227/83, 109, 120, 156, 227/130, 123, 155

[56] References Cited

U.S. PATENT DOCUMENTS

| | | | |
|---|---|---|---|
| 1,945,377 | 1/1934 | Posnack | 227/83 X |
| 2,117,741 | 5/1938 | Polzer | 227/123 |
| 2,122,815 | 7/1938 | Hansen | 227/83 |
| 2,131,473 | 9/1938 | Drypolcher | 227/120 X |
| 2,694,807 | 11/1954 | Shlesinger, Jr. | 227/120 X |
| 2,991,476 | 7/1961 | Seiter | 227/109 |
| 2,994,878 | 8/1961 | Abrahamsen | 227/120 X |
| 3,633,811 | 1/1972 | Ploen | 227/120 X |
| 3,945,414 | 3/1976 | Gordon | 227/83 X |
| 4,040,556 | 8/1977 | Dahle | 227/120 |
| 4,243,168 | 1/1981 | Balma | 227/109 X |

*Primary Examiner*—Paul A. Bell
*Attorney, Agent, or Firm*—Koda and Androlia

[57] ABSTRACT

A stapler including a staple extruding member, a staple magazine and a base plate, which are pivotally held together by means of a pin. Underneath the staple magazine is fitted a sliding member of a specified thickness and shape so as to cover only one side of the staple ejection slot at the front of the staple magazine. The sliding member is mounted on the magazine so as to move from a position underneath the staple ejection slot to a position away from the staple ejection slot and closer to the pin. The staple magazine is adapted to receive a staple holding block, which block carried staples upon its upper surface. The staple holding block is provided with a hollow which extends longitudinally of the block and is open to the upper and lower surfaces of the block by means of a split groove. Inside this hollow is fitted a columnar spring bearing portion of a magazine follower. A detachable spacer may be fitted to the staple ejection slot at the end of the magazine. In addition the staple ejection slot may be provided with a two-step opening for ejection of staples with different lengths and strike area widths.

3 Claims, 43 Drawing Figures

Fig. 3
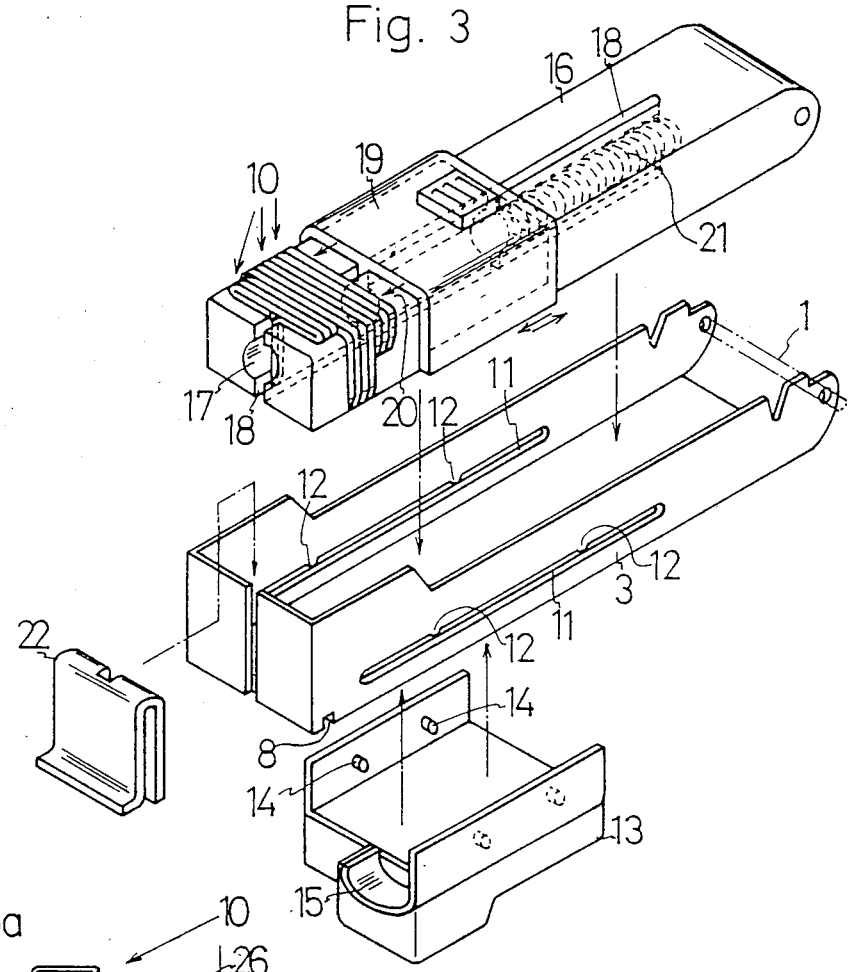
Fig. 5a
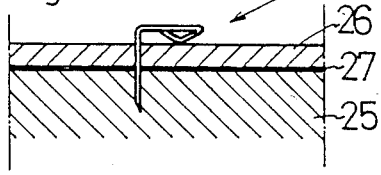
Fig. 5b
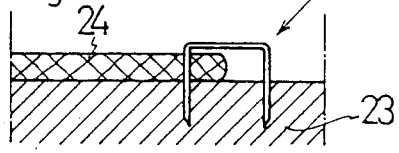
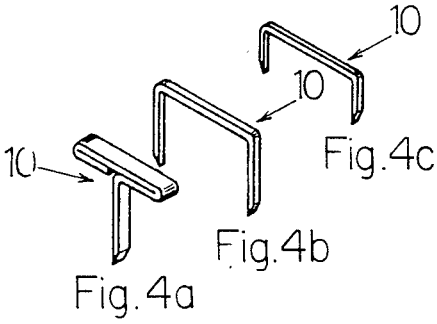

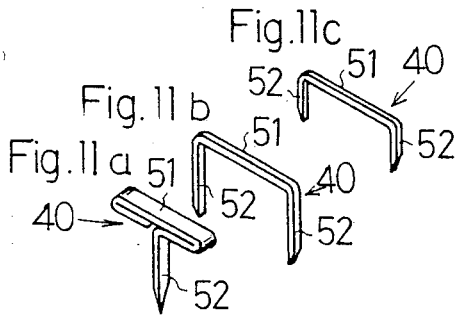
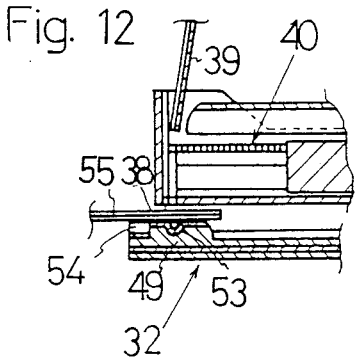
Fig. 17
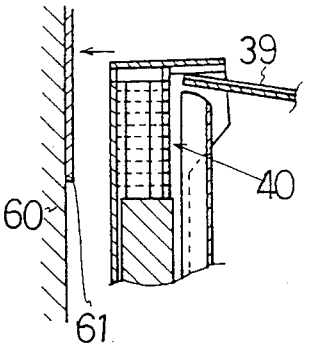
Fig. 15
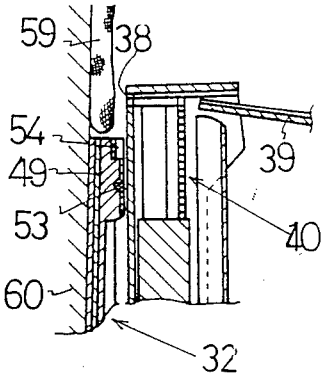
Fig. 13
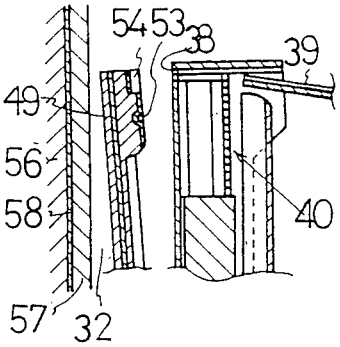
Fig. 18
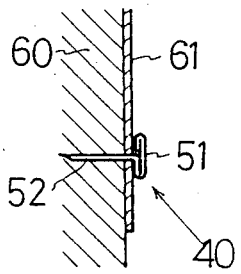
Fig. 16
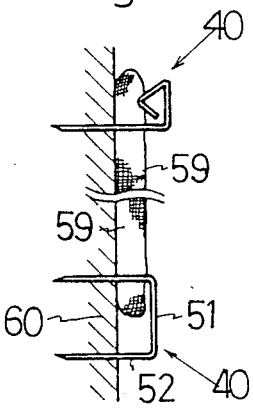
Fig. 14
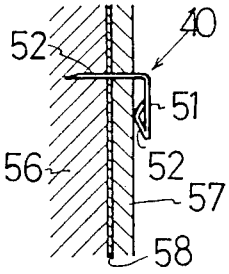

Fig. 24
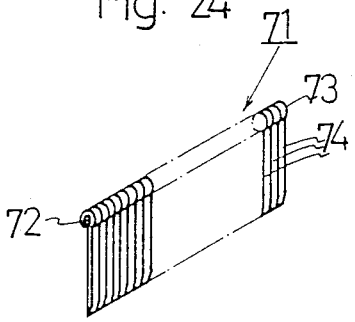
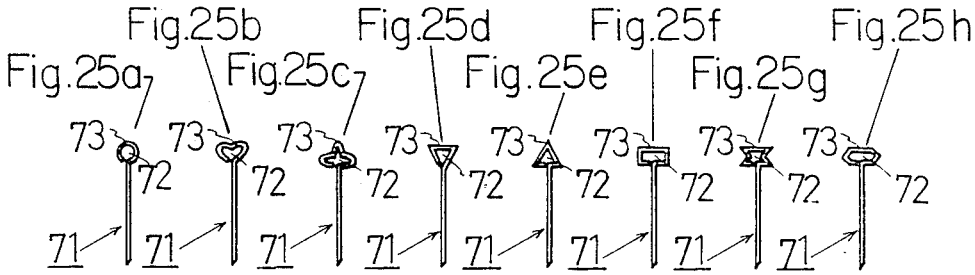
Fig.26a
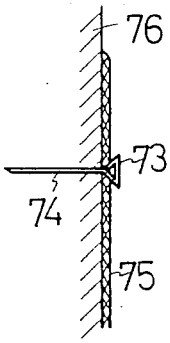
Fig. 26b
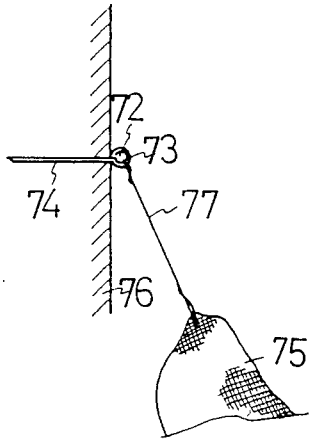

STAPLER AND STAPLES TO BE MOUNTED

BACKGROUND OF THE INVENTION

1. Field of the Invention

The present invention relates to a stapler, and particularly to a multi-purpose stapler that can be used for various types of stapling.

2. Prior Art

In covering ceilings or wall surfaces with ceiling boards or facing plywood, the work is done as follows. Furrings are first coated with adhesive. Then, over the furrings, facing plywoods are placed and fixed by fastening with a large number of tacking nails for temporary nailing. Thereafter, when the adhesive becomes set and thus the adhesion is completed, a large number of temporary fastening nails are pulled off the wall.

Also, in department stores, etc., frequently, clothes are hung in an unfolded and stretched state over the wall surfaces. Such work is done by manually pushing in a large number of pins, one by one.

Neither of the examples described above are easy to do as it requires holding nails or pins in one hand, while repeating the nailing or pinning many times with another hand. The same difficulty applies to work with map pins. If map pins can be fed continuously by using a stapler, the work would be greatly facilitated.

On the other hand, staplers which are widely used for office work are convenient for stapling papers, cloths, sheets, etc. However, such staplers are limited in that they have almost no other functions besides stapling paper sheets together.

SUMMARY OF THE INVENTION

The present invention was brought about after conducting various studies focusing attention on a large number of different types of staples used in a stapler and by taking into consideration that these different types of staples can be easily stapled in succession.

A primary object of this invention is to provide a stapler that can be used for multiple purposes. The multiple purposes here include temporary fastening of facing plywood, etc., pinning for displays or use for office work such as push-pinning and paper binding.

Another object of the present invention is to provide various forms of staples in connection with the multiple purpose stapler as mentioned above.

The aforesaid objects of this invention are achieved by providing a stapler with a structure described below.

A sliding piece is fitted to a staple magazine of a stapler at the position closer to a staple ejection surface. The sliding piece has a specified thickness, and it is formed into a shape to cover only one side of a staple ejection slot. Also, the sliding piece slides the distance between a staple ejecting area and the point closer to a pin.

Inside of the staple magazine, a staple holding block is provided. The staple holding block can carry staples mounted over its upper surface. Along the length of the staple holding block, a hollow is formed. The hollow is connected to the upper and lower external surfaces of the staple holding block by means of a split groove. Into this hollow, a columnar pressing portion disposed at the center of a magazine follower is fitted and held resiliently by a spring. The magazine follower has a section of nearly equal to a vertically split rectangle in shape. On the staple ejection slot side of the staple magazine, a spacer is provided. The spacer has a section of nearly equal to an inverted U in shape, and it is able to be mounted or dismounted.

Also, in connection with the object to propose various forms of staples, as a staple ejection slot with the spacer removed, a two-step slot having a long opening and a short opening is provided so that any staples having long, short, wide, or narrow strike areas, respectively, can be ejected.

Various shapes for various types of staples are also proposed.

BRIEF DESCRIPTION OF THE DRAWINGS

FIG. 3 is an exploded perspective view of the portions of a staple magazine;

FIGS. 4(*a*), 4(*b*) and 4(*c*) are perspective views showing the examples of staples;

FIGS. 5(*a*) and 5(*b*) are sectional views showing the staples in stapled states;

FIGS. 11(*a*), 11(*b*) and 11(*c*) are perspective views showing the examples of the staples;

FIG. 12 is a vertical section showing the essential portion in the state of stapling papers;

FIGS. 13, 15 and 17 are vertical sections showing the same essential portion in other applications;

FIGS. 14, 16, 18, 19 and 20 are vertical sections showing the staples in tacking states;

FIG. 24 is a perspective view showing an embodiment of a strip of the staples;

FIGS. 25(*a*) through 25(*h*) are front views showing the various embodiments of the staples;

FIGS. 26(*a*) and 26(*b*) are side views showing the states of display on wall surfaces;

DETAILED DESCRIPTION OF THE INVENTION

Referring more particularly to the drawings, the following is a description of embodiments of the present invention.

Figure 1:
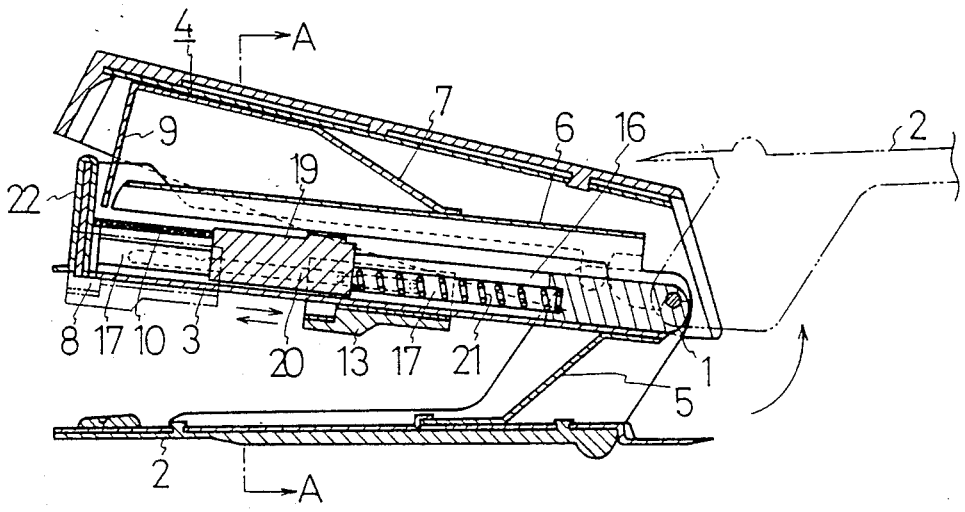
FIG. 1 is a vertical section taken along the center line of a stapler according to the present invention.
Figure 2:
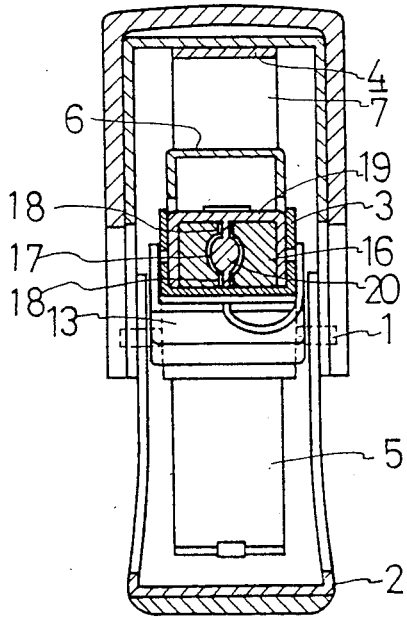
FIG. 2 is an enlarged sectional view taken along the line A—A in FIG. 1.

FIG. 1 is a vertical section taken along the center line of the first embodiment of a stapler according to this invention. FIG. 2 shows an enlarged sectional view taken along the line A—A in FIG. 1. In this stapler, the same as in conventional staplers, a base plate 2, a staple magazine 3 and a staple feeder 4 are combined into a single unit stapler by means of a pin 1 in a rotatable manner. The base plate 2 is kept apart from the staple magazine 3 by means of a spring 5 provided at a location close to the pin 1. Furthermore, a spring 7 of the staple feeder 4 is resiliently held by a spring bearing plate 6 that is also rotatably held by the pin 1. When stapling, the squeezing force causes the base plate 2 and a staple ejection slot 8 of the staple magazine 3 to come close to each other against the force of the springs described above, and a staple driver 9 of the staple feeder 4 pushes out each staple positioned at the end of a strip of a large number of staples 10 which are joined in series, one at a time. Such mechanism described above is the same in this stapler as in conventional staplers.

The most characteristic feature of the present invention is the structure of the staple magazine 3. FIG. 3 is an exploded perspective view of the staple magazine 3. Long slits 11 are provided on both side plates of the staple magazine 3. Each of the long slits 11 are provided with projections 12. By using these long slits 11, a sliding piece 13 is fitted to the underside of the staple magazine 3. As will be described later, the sliding piece 13 has a specific thickness, and its section has a nearly equal to an inverted U shape as shown in FIGS. 1 through 3. Protrusions 14 for fitting the long slits 11 are formed on both sides of the sliding piece 13. The end of the sliding piece 13 is formed into a shape to cover nearly a half of the staple ejection slot 8, and also, a recess is made in this portion in order to provide a staple bending portion 15. When the sliding piece 13 is fitted to the staple magazine 3, the sliding piece 13 slides optionally along the distance between the staple ejection slot 8 and the point closer to the pin 1. Also, it is possible to keep the sliding piece 13 at a specific position by means of the projection 12. The method for using this sliding piece 13 will be described in detail later.

Conventionally, staples are loaded inside the magazine 3, and those staples are moved successively to the staple ejection slot 8 by the staple feeder 4. However, in the present invention, a specific structure is provided so that various types of staples shown in FIG. 4 can be loaded. That is, as seen in the upper portion of FIG. 3, a staple holding block 16 that is fitted inside the staple magazine 3 is a completely new type of component that has never been found in the conventional staplers. This staple holding block 16 can be either rotatably mounted to the pin 1 with other members or fixed to the internal bottom surface of the magazine 3. Inside of the staple holding block 16, a hollow 17 is formed. This hollow 17 is opened to the upper and lower external surfaces of the staple holding 16 by means of a split groove 18. Consequently, the staple holding block 16 can carry not only the ordinary types of staples shown in FIGS. 4(*b*) and and 4(*c*), but also a T-shaped staple shown in FIG. 4(*a*), which has only one needle at the center. Onto this staple holding block 16, a magazine follower 19 with a section as shown in FIG. 2 is mounted. As also seen in FIG. 2, the magazine follower 19 is provided with a columnar spring bearing portion 20 at its center. This spring bearing portion 20 is fitted in the hollow 17 and is resiliently pressed and supported by a spring 21 that is mounted in the hollow 17. In stapling, the staples having two needles are moved towards the ejection slot 8 by getting pressed not only at their upper portion but also at their needles by the magazine follower 19. The staples having only one needle are also fed to the ejection slot 8 securely by getting pressed at their needles by the columnar spring bearing portion 20 of the magazine follower 19.

Different from conventional types of staplers, the staple ejection slot 8 at the end of the magazine 3 of this stapler is designed to be applicable to both wide and narrow staples by widening its opening. Therefore, for using the staple with an ordinary width, a spacer 22 with a section as shown in FIG. 3 is fitted on the staple ejection slot side as seen in FIG. 1. For the use of the staple 10 with a thick width as shown in FIG. 4(*a*), the spacer 22 is detached so that the staple ejection slot 8 becomes wider.

The stapler according to the present invention is used as described below.

First, for using the stapler as ordinary stapler for binding papers, etc., the sliding piece 13 on the magazine 3 is moved to the position closer to the pin 1 as shown by the solid lines in FIG. 1. Also, the spacer 22 is fitted to the front plate of the staple ejection slot 8. In this state, the sliding piece 13 does not come into contact with the base plate 2 during driving of the stapler, and the stapler can be used in the same manner as ordinary staplers.

Next, for using the stapler to fix clothes, etc. onto wall surfaces for display, the staples having longer needles as shown in FIG. 4(*b*) are used. These staples are loaded on the staple holding block 16. The slidng piece 13 is moved to the position right before the staple ejection slot 8. The base plate 2 is rotated as indicated by the two-dot chain line in FIG. 1. Then, the staple 10 is driven in from over the clothes as shown in FIG. 5(*b*). Thus, a garment 24 can be fastened onto the wall surface 23 with its feel of clothes kept intact. The distance between the wall surface 23 and the strike area at the top of the staple 10 is determined by the thickness of the sliding piece 13. The staple driven in this manner can be easily pulled off the wall as it is protruding from the wall surface.

For driving the staple 10 in order to temporarily hold a facing plywood 26 until an adhesive layer 27 is completely set in the work to adhere the facing plywood 26 onto a furling strip 25 by using an adhesive as shown in FIG. 5(*a*), the following method is used. By moving the sliding piece 13 to the position nearby the front end of the magazine 3, one side of the staple ejection slot 8 is covered with the staple bending portion 15. The base plate 2 is rotated same as in the case mentioned previously in order to keep the staple ejection slot 8 in the state clear of the base plate 2. With this state, when the staple feeder 4 is struck with hand or mallet, one of the needles of the staple 10 is bent by the bending portion 15 of the sliding piece 13, and only another needle is driven into the furring 25 from over the facing plywood 26. This way, the temporary tacking can be effected. Because of the bent portion formed on the staple, the staple can also be easily pulled off after the complete setting of the adhesive.

FIG. 4(*a*) shows a T-shape staple 10 with one needle, that can be used in place of a push pin. It is also a new feature of the present invention that this stapler is designed, different from the conventional type of staplers, to be able to staple also the above-mentioned push pin type staple 10. Besides, because the structure of this staple 10 is simpler than the conventional push pin, it can be used with lower cost. In addition, a mechanical pinning can be made by this invention, resulting in improved work efficiency.

Since the stapler according to this invention is provided with the structure as described above, it can be used in various ways. The stapler can be used as an ordinary stapler if the sliding piece is positioned closer to the pin 1 by moving the sliding piece along the longitudinal direction of the magazine. The stapler can be used to effect double stabbing with the staple for displays, if the sliding piece is positioned right before the staple ejection area. The stapler can also be used for temporary tacking of the facing plywood with single stab of only one of the needles of the staple, if the sliding piece is set at the position to cover only one side of the staple ejection area. Furthermore, the stapler can be used for stapling with both thick and thin staples through mounting and dismounting the spacer. Moreover, the stapler can be used with whichever the staples, that with single needle, or that with two needles. From the foregoing description, it should be apparent that the present invention is significant in that it enables versatile use for a stapler.

The staples struck in by the stapler of this invention are all easily pinched and pulled off, whether they are for temporary tacking or for display. Also, by the use of the staples stapled by this stapler, various forms of decorations can be made, as merchandise can be displayed over the space in a stretched state by handing them with strings which are threaded through those staples. In addition, with the stapler according to the present invention, the work can be done in shorter time with less labor than the work done by the conventional type of stapler. Therefore, the present invention contributes greatly to the rationalization of work.

The second embodiment is a stapler wherein a further improvement is worked out from the first embodiment. This stapler can be used with whichever the staples, wide, narrow, long, or short in their strike areas, without using any special attachment such as the spacer.

For that purpose, a staple feeder, staple magazine and base plate are combined into a single unit by means of a pin in a rotatable manner, and the staple ejection slot at the end of the staple magazine is opened in two-steps, i.e. long and short steps, so that the staples can be ejected from the ejection slot regardless of the width and length of their strike areas.

Figure 6:
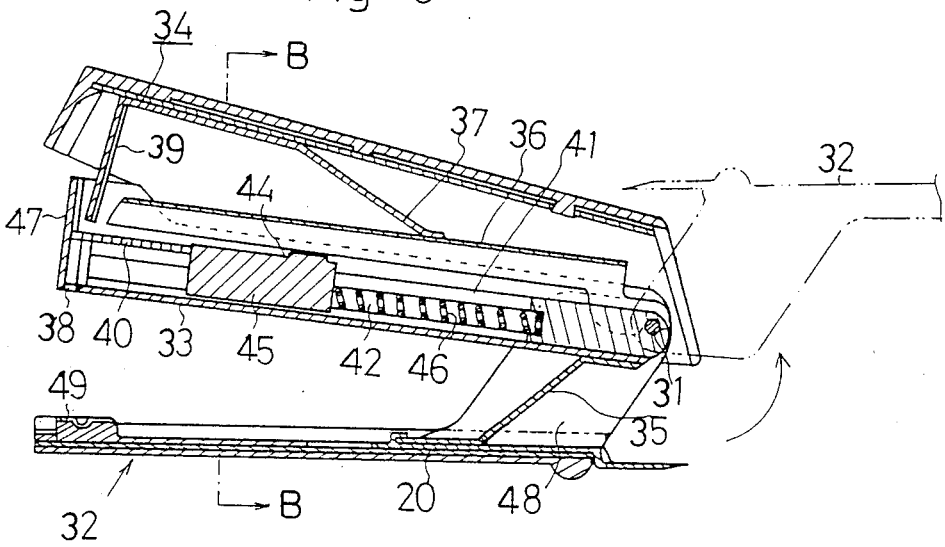
FIG. 6 is a central sectional view of the second embodiment of the stapler according to this invention.
Figure 7:
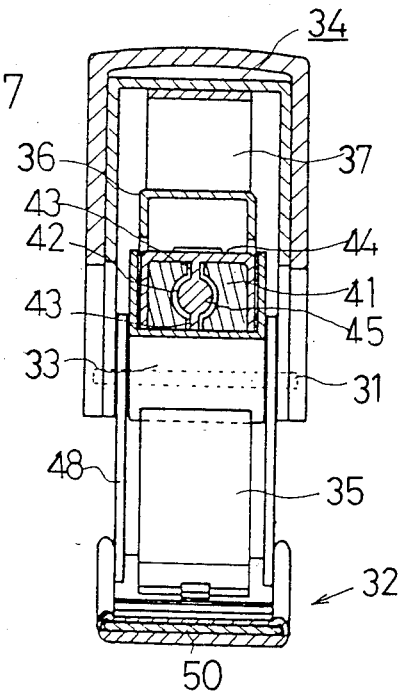
FIG. 7 is an enlarged sectional view taken along the line B—B in FIG. 6.

FIG. 6 is a vertical section taken along the center line of the second embodiment of the stapler. FIG. 7 is an enlarged sectional view taken along the line B—B in FIG. 6. Same as in the first embodiment of the stapler, in this stapler, the base plate 32, the staple magazine 33 and the staple feeder 34 are combined into a single unit in a manner to be rotatable by means of the pin 31. The base plate 32 is kept spaced from the staple magazine 33 by means of the plate spring 35 provided at the position closer to the pin 31. The spring portion 37 of the staple extruding member 34 is held resiliently by the spring bearing plate 36 that is also rotatably held by the pin 31.

When the stapler is used for stapling papers, the base plate 32 and the staple ejection slot 38 of the staple magazine 33 come close to each other against the force of the spring 35. Also, the staple driver 39 extrudes the individual staple at the end of a strip of the staples 40 which are joined in large number in successive manner, one by one. In the stapler provided with the structure mentioned above, which is different from the first embodiment in terms of the structure of the staple magazine 33, the form of the staple ejection slot 38, and the design that makes it possible for the base plate 32 to move back and forth.

Hereunder, the internal structure of the staple magazine 33 will be described with reference to the exploded perspective view in FIG. 8. Conventionally, inside of the staple magazine 33, staples were housed, and those staples were moved toward the staple ejection slot 38 successively by the magazine follower. However, in this embodiment, a special structure is provided so that various types of staples as shown in FIG. 4 and FIG. 11 can be loaded. The staple holding block 41 fitted in the staple magazine 33 is either mounted on the pin 31 with other component members or fixed to the internal bottom surface of the staple magazine 33. Inside of the staple holding block 41, the hollow 42 is provided. This hollow 42 is connected to the upper and lower external surfaces of the staple holding block by means of the split groove 43. Consequently, not only the ordinary type staples as shown in FIGS. 11(*b*) and 11(*c*), but also the T-shaped staples having only one needle at its center and having the wide and short strike area 51 as shown in FIG. 11(*a*) can be loaded.

Figure 8:
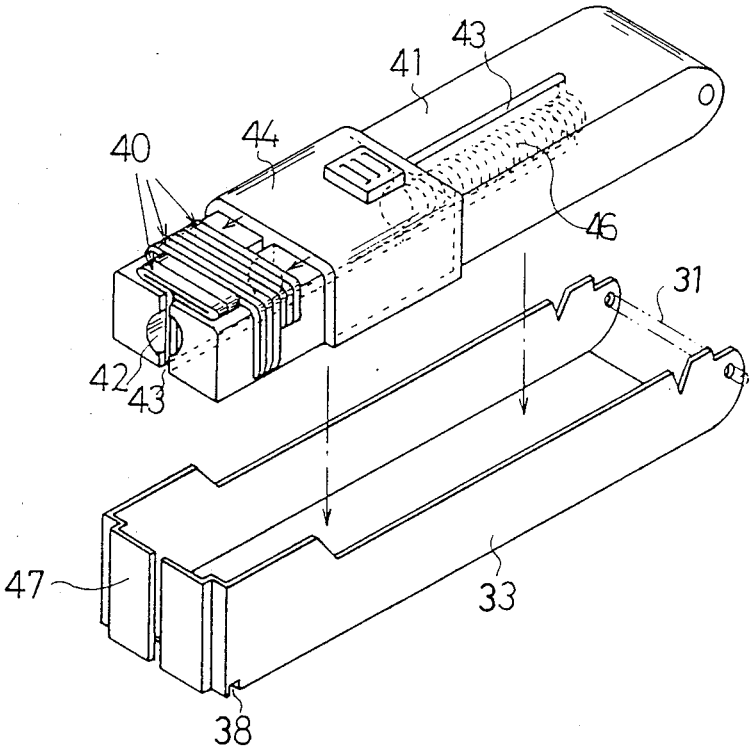
FIG. 8 is an exploded perspective view of the portions of the magazine.

Onto this staple holding block 41, the magazine follower 44 with the section as shown in FIG. 8 is mounted. As seen also in FIG. 7, the magazine follower 44 is provided with the columnar spring bearing portion 45 at its center. This columnar spring bearing portion 45 is fitted in the hollow 42 and resiliently held by the spring 46 that is inserted in the hollow 42. The staple 52 having two needles is fed towards the staple ejection slot 38 by being pressed not only at its top area but also at its both needles. Also the staple having only one needle is moved towards the ejection slot 38 securely by getting pressed at its needle portion by one side of the columnar spring bearing portion 45. The structure of this portion is the same as that of the first embodiment.

Being different from the conventional type of staplers, the staple ejection slot 38 at the end of the staple magazine 33 is designed to be able to use the staples whether their strike areas 51 are long or short, by providing it with the twostep widths, i.e. long and short for its opening.

Figure 9A:
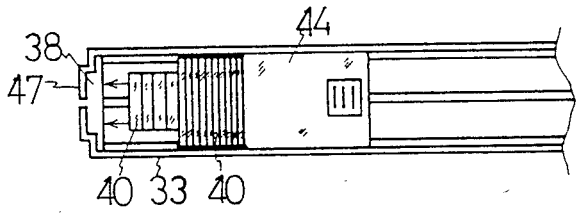
FIGS. 9(*a*), 9(*b*) and 9(*c*) are plan views of the essential portions thereof.
Figure 9B:
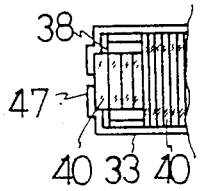
Figure 9C:
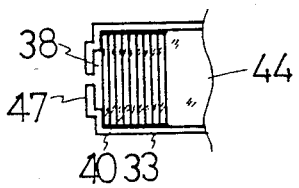

For using the oridnary staples as shown in FIGS. 11(*b*) and 11(*c*), each of the staples is ejected from the longer portion of the two-step opening of the ejection slot 38 as shown in FIG. 11(*c*). On the other hand, for ejecting the staple with wide and short strike area 51 as shown in FIG. 9(*b*) and FIG. 11(*a*), a half of the staple is fitted to the shorter portion of the staple ejection slot 38, and the remaining portion of the staple is ejected from the longer portion of the ejection slot 38. To form the ejection slot 38 into such shape as mentioned above is made possible by forming the stepped portion through bending the staple backing wall 47 of the staple holding member 33. When the staple 40 is long in its strike area 51, it is pressed by the longer portion of the steps of the staple backing wall 47, while the staple 40 that is short in its strike area 51 is pressed by the shorter portion of the steps, in waiting to be ejected.

Figure 21:
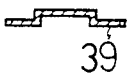
FIGS. 21, 22 and 23 are transverse sections of staple drivers.
Figure 22:
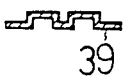
Figure 23:
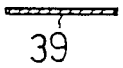

Because the staple ejection slot 38 of the second embodiment of the stapler is constructed as described above, it is preferable also for the driver 39 for ejecting the staples to have the vertical rib structure as shown in FIGS. 21 and 22, instead of the flat structure as shown in the transverse section in FIG. 23. The reason for the above is that, with the former structure, the impact force is applied to the staples evenly regardless of the width of the staple.

Figure 10:
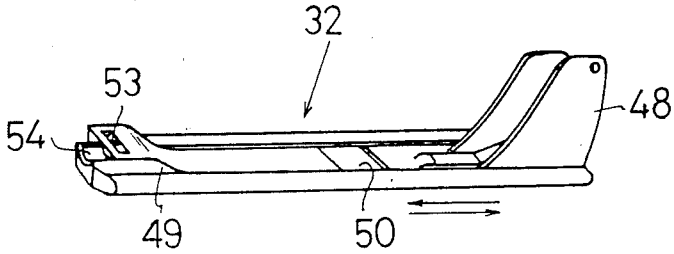
FIG. 10 is a perspective view of a base plate.

In the stapler shown here, the base plate 32 also has a specific structure that has not been found in the conventional type of staplers. That is, the base plate 32 is not only rotatable around the pin 31 same as the ordinary staplers, but also slidable back and forth. For that purpose, as shown in the perspective view in FIG. 10, the base plate 32 is divided into a base section 48 and a staple bending section 49. The both edges of the staple bending section 49 is bent for inserting a core 50 internally, and the base section 49 is loosely inserted between those edges.

The structure of the staple bending section 49 (anvil) is also not found in the prior art. In other words, the bending section 49 is provided with, in addition to a standard bending hole 53, a bending hole 54 with one side of it cut off, in order to bend only one of the needles of a staple.

The stapler according to this invention can be used for multiple purposes by the following ways. Of the staples used, those with long and narrow strike areas 51 are used for stapling papers, displays and temporary tacking of facing plywoods in the work to adhere them. On the other hand, the staples with short and wide strike areas 51 are used in place of push pins. The description on how to use the stapler with those staples will be given below.

First, when the stapler is used for stapling papers same as the ordinary staplers, the standard staples are loaded on the staple holding block 41 as shown in FIG. 9(*c*). Then, as seen in FIG. 12, the base plate 32 is adjusted so that the ordinary staple bending hole 53 of the base plate 32 comes under the staple ejection slot 38. In this state, the papers 55, etc. are inserted between the base plate 32 and the staple ejection slot 38 and stapled. When the stapler is kept in such state, it can be used just the same as the ordinary staplers.

Next, as shown in FIGS. 13 and 14, in the use of the stapler to drive in the staples 40 for temporary tacking until the adhesive layer 58 becomes completely set in the work to adhere the facing plywood 57 onto the furring 56 by using the adhesive, each staple of 40 is driven in with the state of the stapler wherein the bending hole 54 for bending only one of the needles of a staple, that is located at the end of the base plate 32, is positioned under the staple ejection slot 38. This way, as shown in FIG. 14, while one of the needles 52 of the staple 40 pierces through the facing plywood and reaches the furring, another needle 52 is bent and remains on the facing plywood. When the staple 40 is stapled in this manner, the temporary tacking staple can be quite easily pinched and extracted after the adhesive layer is solidified.

In the past, for decoration display by fixing clothes, etc. to walls, the tacking was performed by manually pushing the push pins into the wall one by one. However, by the use of this stapler, the push pins can be knocked in mechanically. In other words, the standard staples or a little longer staples 40 are loaded on the staple holding block 41. Then, as seen in FIG. 15, with the base plate 32 slided and positioned at the point retreated from the staple ejection slot 38, the staple 40 is ejected to the wall 60 from over the display object 59. Because the staple 40 is ejected in a manner to leave the space between the strike area (top area) 51 of the staple 40 and the wall surface, the display object is kept intact in its threedimensional feel and look. This method is advantageous also in that it facilitates the extraction of the staples 40 after the display as the space is secured as mentioned above. In addition, the stapler can also be used as shown in the upper portion of FIG. 16 by ejecting the staple with the state as shown in FIG. 13. The description on this point will be given later.

Figure 19:
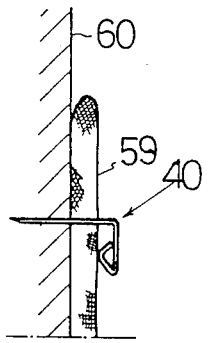

Furthermore, as shown in FIGS. 17 and 19, for positioning notices 61, etc. such as posters on the wall 60, instead of map pins, the T-shape staple having only one needle 52 at its center can be stapled with this stapler. The example of the foregoing staple 40 is shown in FIG. 11(*a*). In comparison with the standard staple, the strike area 51 of this staple is about twice in width and shorter in length. As shown in FIGS. 8, 9(*a*) and 9(*b*), when such pin shaped staple 40 is pressed by the staple pressing member 44 while supporting the staple 40 by inserting its needle into the split groove 43 of the staple holding block 41, the staple 40 comes to be positioned on both long and short openings of the staple ejection slot 38. When, as shown in FIGS. 17 and 18, the staple 40 is ejected from over the posting object 61 on the wall 60 with the state wherein the base plate 32 is cleared by rotating it as indicated by the two-dot chain line in FIG. 6, the posting object can be fastened same as with the map pin.

Figure 20:
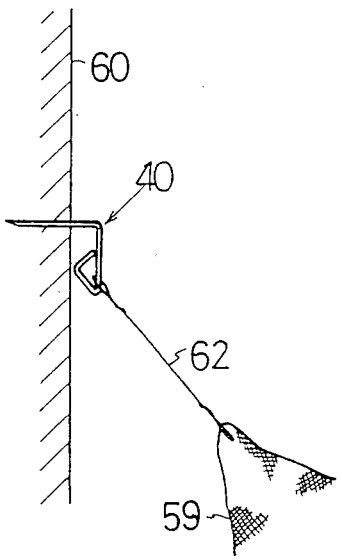

By applying the method for using the stapler in the state same as in FIG. 13, the stapler can be used also for the display mentioned previously, as shown in FIGS. 19 and 20. In FIG. 19, when the staple 40 with one of the needles bent is stapled to the wall 60 through its surface from over the display object 59, the staple 40 fastens the display object securely without impairing the three-dimensional feeling of it. FIG. 20 shows an example wherein a loop formed by bending the ejected staple 40 is threaded, and the display object 59 is hung in a stretched state in the space by means of the thread 62 held by the loop.

The second embodiment of the stapler also has the versatile use same as the previously mentioned first embodiment. With the use of this stapler, the staples are given the multiple functions. In particular, they can be used as substitution for the push pins and setting pins for display. Also, the staples can be used for stapling papers in their standard application. Specifically, the staples used for tacking are all easily pinched and pulled off, whether they are for temporary tacking or for display. Furthermore, because the gap can be secured between the staple driven in for display and the wall surface, it is possible to hang the merchandise in stretched state in the space by passing the thread through the foregoing gap. In addition, for driving, various forms of staples can be loaded at the same time on the staple holding block, and also, they can be driven into an object optionally. Moreover, by the use of this stapler, it becomes feasible to complete both the display work and the posting work in shorter time and with less labor than the conventional method. Therefore, the present invention contributes greatly to the economization of work.

When the staples used for display, etc., in addition to those mentioned before and shown in FIG. 4 and 11, those having the shape described below are preferrable. This is, staples referred to herein are a strip of successively bonded together large number of staples each of which has a strike area with a threading hole that is formed by bending the upper portion of the staple, while the lower portion thereof is sharpened to make a pointed end. The structure of the stapler to be used for display will also be described below.

Figure 27:
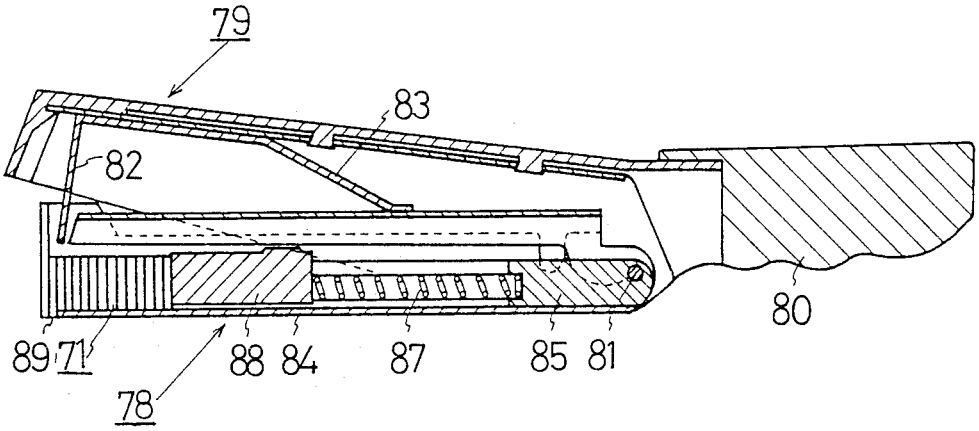
FIG. 27 is a central vertical section of a tacker type stapler.
Figure 28:
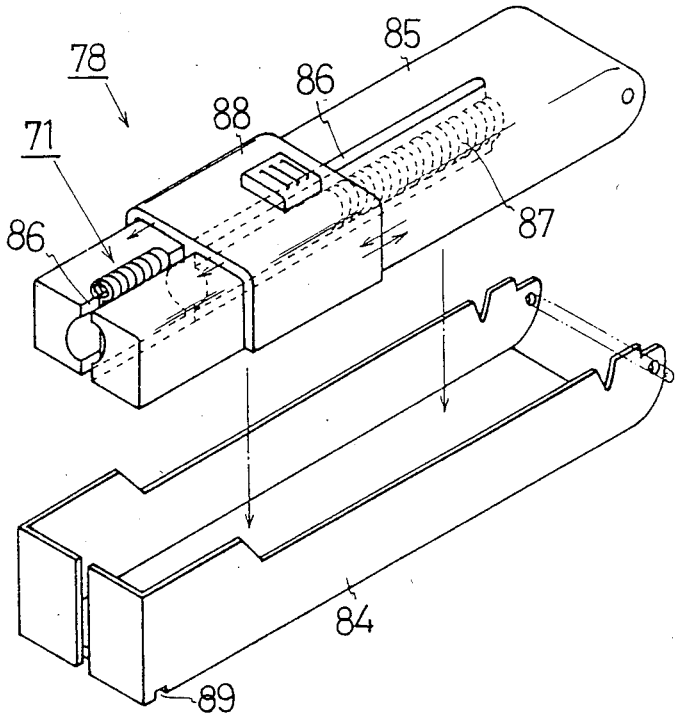
FIG. 28 is an exploded perspective view of the staple magazine.

FIG. 24 is a perspective view showing the staples for display work. FIGS. 25(*a*) through 25(*h*) are the front views showing the respective types of such staples. FIGS. 26(*a*) and 26(*b*) are the side views showing the states of display on the wall surface. FIG. 27 is a vertical section taken along the center line of the tacker suitable for driving the staples mentioned above. FIG. 28 is the exploded perspective view showing the magazine.

As should be apparently understood from FIG. 24 through FIG. 26, the display staples 71 (hereinafter abbreviated as the staples) are meant to be a strip of staples formed by successively adhering a large number of unit staples 74. The unit staple 74 is formed from a linear material by bending its upper portion to provide a strike area 73 having a hole 72 for threading and by sharpening its lower portion to provide a pointed end.

The strike area 73 provided on top of each unit staple 74 can be formed into various shapes as shown in FIGS. 25(*a*) through 25(*h*). Represented by 25(*a*) is the unit staple same as that shown in FIG. 24, and its strike area 73 is formed into a ring-shape. When this ring is bent to be the smallest possible circular form, it becomes appropriate to be used for display. Represented by 25(*b*) is the unit staple with the strike area 73 formed with a heart shape, and 25(*c*) is an example of the unit staple with trefoiled strike area 73. The strike area 73 can be further formed into various shapes for bringing about the decorative effect. For example, as seen in 25(*d*) and 25(*e*), the strike area may be formed into a triangle, or into a square as seen in 25(*f*). The strike area can be a square shape with dents at middles as shown in 25(*g*), or a square shape with bulges as shown in 25(*h*). The strike area 73 can also be made colorful by painting it with various colors.

FIGS. 26(*a*) and 26(*b*) show the examples of application of those display staples. Shown in 26(*a*) is an example wherein the unit staple 74 is directly ejected toward the wall surface 76 from over the clothes 75, etc. by using the tacker as will be mentioned later. The example 26(*b*) shows that the unit staple 74 is shot to the wall surface 76, next, the thread 77 is passed through the threading eye 72 and tied, then, the garment 75 is tied to the other end of the thread 77. Different from the conventional setting pin, etc., this staple is provided with the threading eye 72. Consequently, the staple is advantageous in that it greatly facilitates the work for decoration, and the thread does not come off. Besides, because the strike areas 73 has in its inside the threading eye 72, the staple can be easily extracted from the wall, etc. after the use. If the space just enough for the thread to pass through it is provided at the base of the threading eye 72, the use of the staple will become more convenient.

For the use of the staples as mentioned above, the following devices may be used: As a device for driving in the staples one by one separately, a conventional box nailing machine; a single point staple shooting machine (commonly called a pin tacker); a two point staple shooting machine (commonly called a gun tacker) having a staple loading portion remodeled to be able to shoot the slender nails for temporary tacking of the facing plywood.

However, since these devices are large in size, the remodeled type of the stapler as shown in FIG. 27 is handy to be used at a work site. This stapler shown as the third embodiment is the same as the first and second embodiments in its essential portion. It includes the staple magazine 78 and the staple drive-in member 79 as the primary structural components, and the rear portion, if necessary may be provided with a handle grip 80 for making it easy to hold. The staple magazine 78 and the staple drive-in member 79 are combined at their rear portions into a single unit in a rotatable manner by means of the pin 11. Between the staple holding member 78 and the staple drive-in member 79, the plate spring 83 that is combined with the driver 82 into a single unit is provided in a manner to support the foregoing both members, resiliently. As shown in FIG. 28, the staple magazine 78 has a specific structure. In the holding member 84 with the shape same as the staple holding member that has been used for the conventional type of stapler, the staple holding block 85 is fitted. The staple holding block 85 is provided with the staple holding groove 86 at its center area along the length of the block 85. This groove 86 is hollow inside, having a coiled spring 87 in it. Furthermore, onto the staple holding block 85, the magazine follower 88 with the section as shown in FIG. 28 mounted, and the foregoing coiled spring 87 presses it from behind. When the staples 71 are inserted into the staple holding groove 86, the magazine follower 88 presses the staples 71 towards the staple ejection slot 89. With such a structure when the staple drive-in member 79 is pressed or struck, the unit staple 74 can be driven in separately one at a time.

It is difficult to form a strip of push pins by bonding a large number of them successively together because their strike areas hindere such a formation. However, since the staples having the shapes as mentioned above are vertically flat in their strike area, they can be joined and adhered into a serial body. Consequently, it becomes possible to use mechanical tacking, thereby bringing about improved work efficiency and labor savings. Also, because the strike area has a space for threading, the extraction of the staple can be done easily by using this space. In addition, the foregoing threading loop makes it easier to pass the thread through it. Including those mentioned above, these staples have a lot of merits.

I claim:

1. A stapler comprising a staple extruding member, a staple ejection slot, a staple holding member and a base plate having a staple bending member which are all combined into a single unit in a manner to be able to rotate by means of a pin, said stapler characterized in that:

a detachable spacer is fitted adjacent the staple ejection slot at the end of the staple magazine; and a sliding piece that slides a distance between a first position adjacent said staple ejection and a second position closer to the pin fitted to the underside of the staple magazine, said sliding piece having a predetermined thickness and also a staple bending portion for covering only one side of the staple ejection slot when said sliding piece is in said first position.

2. A stapler comprising a staple extruding member, a staple ejection slot, a staple magazine, and a base plate having a staple bending member which are combined into a single unit in a rotatable manner by means of a pin, said stapler characterized in that:

a sliding piece that slides a distance between a first predetermined position adjacent said staple ejection slot and a second position closer to the pin is fitted to an under side of said staple magazine, said sliding piece having a predetermined thickness and also a staple bending portion for covering only one side of the staple ejection slot when said sliding piece is in said first position;

a staple holding block for holding staples loaded over its upper surface fitted inside of said staple magazine, said staple holding block being provided with a hollow formed groove along its longitudinal direction, said hollow being connected to upper and lower surfaces of the staple holding block by means of a split groove; and a columnar spring bearing portion at a center of a magazine follower fitted in said hollow of the staple holding block, said columnar spring bearing portion being held resiliently a spring.

3. A stapler comprising a staple feeder, a staple magazine and a plate having a staple bending member which are all combined in a single unit in a manner to be rotated by means of a pin, said stapler characterized in that:

a staple ejection slot at the end of the staple magazine is stepped to provide a long and a short opening, for enabling ejection of staples with long, short, wide or narrow strike areas; and a sliding piece that slides a distance between a first position adjacent said staple ejection slot and a second position closer to the pin fitted to an underside of said staple magazine, said sliding piece having a predetermined thickness and also a staple bending portion for covering only one side of the staple ejection slot when said sliding piece is in said first position.

* * * * *